US012312803B2

(12) United States Patent
Ferris et al.

(10) Patent No.: US 12,312,803 B2
(45) Date of Patent: May 27, 2025

(54) WORKSPACE WALL PANELS AND SYSTEMS INCLUDING SAME

(71) Applicant: HNI Technologies Inc., Muscatine, IA (US)

(72) Inventors: Gregory Ferris, Muscatine, IA (US); Mitchell R. Bakker, Holland, MI (US); Austin Blough, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 74 days.

(21) Appl. No.: 18/369,560

(22) Filed: Sep. 18, 2023

(65) Prior Publication Data

US 2024/0011285 A1 Jan. 11, 2024

Related U.S. Application Data

(63) Continuation of application No. 17/580,122, filed on Jan. 20, 2022, now Pat. No. 11,795,686.

(60) Provisional application No. 63/140,168, filed on Jan. 21, 2021.

(51) Int. Cl.
*E04B 2/74* (2006.01)

(52) U.S. Cl.
CPC ..... *E04B 2/7422* (2013.01); *E04B 2002/749* (2013.01)

(58) Field of Classification Search
CPC ..... E04B 2002/7488; E04B 2/7422; E04B 2002/749; H02G 3/288; H02G 3/388
See application file for complete search history.

(56) References Cited

U.S. PATENT DOCUMENTS 4,267,677 A * 5/1981 Randolph ..... E04B 2/7422 52/717.05
4,372,092 A * 2/1983 Lopez ..... E04C 2/521 106/711
5,396,027 A * 3/1995 Zemen, Jr. ..... H01R 25/00 174/494
5,479,747 A * 1/1996 Wu ..... E04B 2/7422 52/656.1
5,595,495 A * 1/1997 Johnson ..... H01R 25/16 174/541
5,826,385 A * 10/1998 Dykstra ..... E04B 2/7422 403/231
5,881,500 A * 3/1999 Latino ..... H02G 3/288 52/36.6
5,901,512 A * 5/1999 Bullwinkle ..... H02G 3/288 52/239
6,037,538 A * 3/2000 Brooks ..... H02G 3/288 174/498

(Continued)

*Primary Examiner* — Theodore V Adamos
(74) *Attorney, Agent, or Firm* — Faegre Drinker Biddle & Reath LLP

(57) ABSTRACT

A wall panel for a workspace system includes a monolithic wall portion and a cover carried by the monolithic wall portion. The monolithic wall portion includes a first surface, an aperture including a wall opening formed on the first surface, and a second surface opposite the first surface. The cover includes a channel adjacent to the first surface, and the channel and the aperture together define an internal chamber. The cover further includes a cover opening coupled to the channel. The wall panel further includes an electrical assembly carried in the internal chamber. The electrical assembly includes a receptacle that is accessible via the cover opening.

5 Claims, 16 Drawing Sheets

(56) References Cited

U.S. PATENT DOCUMENTS

| | | | | |
|---|---|---|---|---|
| 6,173,536 | B1 * | 1/2001 | Boyce | E04B 2/7433 52/220.1 |
| 6,253,509 | B1 * | 7/2001 | Hellwig | E04B 2/7422 52/239 |
| 6,497,075 | B1 * | 12/2002 | Schreiner | F21V 33/0012 52/239 |
| 6,575,777 | B2 * | 6/2003 | Henriott | H01R 25/162 439/654 |
| 7,294,005 | B1 * | 11/2007 | Laukhuf | H01R 25/162 439/215 |
| 7,651,353 | B2 * | 1/2010 | Laukhuf | H01R 25/006 439/211 |
| 7,741,568 | B2 * | 6/2010 | Makwinski | H02G 3/0431 174/68.3 |
| 9,048,642 | B1 * | 6/2015 | Gretz | H02G 3/00 |
| 10,159,616 | B2 * | 12/2018 | Newkirk | A61G 12/005 |
| 2003/0194588 | A1 * | 10/2003 | Laukhuf | H02J 5/00 429/444 |
| 2006/0024996 | A1 * | 2/2006 | Johnson | H02G 3/00 439/215 |
| 2007/0107335 | A1 * | 5/2007 | Laukhuf | E04B 2/7422 52/239 |
| 2011/0162291 | A1 * | 7/2011 | Hilliard | E04B 2/7422 52/302.1 |
| 2012/0096780 | A1 * | 4/2012 | Metcalf | E04C 2/521 52/173.1 |
| 2013/0061549 | A1 * | 3/2013 | Biadora | E04B 2/12 52/582.1 |
| 2013/0326976 | A1 * | 12/2013 | Jeffers | E04B 2/7422 52/239 |
| 2014/0368476 | A1 * | 12/2014 | Rauch | A47B 21/06 345/204 |

* cited by examiner

WORKSPACE WALL PANELS AND SYSTEMS INCLUDING SAME

CROSS-REFERENCE TO RELATED APPLICATION

The present application is a continuation of U.S. application Ser. No. 17/580,122, filed Jan. 20, 2022, titled WORKSPACE WALL PANELS AND SYSTEMS INCLUDING SAME, now U.S. Pat. No. _____, which claims the benefit of and priority to, under 35 U.S.C. § 119(e), U.S. Provisional Application Ser. No. 63/140,168, filed Jan. 21, 2021, titled WORKSPACE WALL PANELS AND SYSTEMS INCLUDING SAME, which are hereby incorporated by reference in their entireties for all purposes.

TECHNICAL FIELD

The present invention relates to workspace wall panels and systems, particularly panels and systems including electrical assemblies for providing power and/or data to workspace users.

BACKGROUND

Workspace or "cubicle" systems are commonly used in office settings due to their reconfigurability, customizability, and scalability. The wall panels of such systems may be constructed of various materials, including aesthetic appealing materials such as stained wood. However, such panels, which are commonly referred to as "gallery" panels, are typically constructed as monolithic components, which creates challenges for routing power and/or data conduits to the workspaces. As such, improved workspace wall panels and systems would be beneficial.

SUMMARY

In a first example, a wall panel for a workspace system includes a monolithic wall portion and a cover carried by the monolithic wall portion. The monolithic wall portion includes a first surface, an aperture including a wall opening formed on the first surface, and a second surface opposite the first surface. The cover includes a channel adjacent to the first surface, and the channel and the aperture together define an internal chamber. The cover further includes a cover opening coupled to the channel. The wall panel further includes an electrical assembly carried in the internal chamber. The electrical assembly includes a receptacle that is accessible via the cover opening.

In a second example, the wall panel of the first example, wherein the cover is a first cover, the channel is a first channel, the cover opening is a first cover opening, the receptacle is a first receptacle and the electrical assembly further includes a second receptacle, the wall opening is a first wall opening, and the aperture further includes a second wall opening formed on the second surface. The wall panel further includes a second cover carried by the monolithic wall portion. The second cover includes a second channel adjacent to the second surface, and the second channel, the first channel, and the aperture together define the internal chamber. The second cover further includes a second cover opening coupled to the second channel. The second receptacle is carried in the internal chamber and is accessible via the second cover opening.

In a third example, the wall panel of the first example, wherein the aperture is a blind aperture.

In a fourth example, the wall panel of the first example, wherein the electrical assembly further includes an electrical conduit coupled to the receptacle, and the electrical conduit is disposed in the internal chamber.

In a fifth example, the wall panel of the first example, further including a mounting bracket disposed in the aperture and coupling the electrical assembly to the monolithic wall portion.

In a sixth example, the wall panel of the first example, further including a snap connector coupling cover to the monolithic wall portion.

In a seventh example, a wall panel for a workspace system includes a monolithic wall portion, a cover, and an electrical assembly. The monolithic wall portion includes a first surface, a second surface opposite the first surface, and an aperture including a wall opening formed on the first surface. The cover is carried by the monolithic wall portion and is disposed outwardly from the first surface. The cover includes a cover opening. The electrical assembly is carried in the aperture, and the electrical assembly includes a receptacle extending through the cover opening.

In an eighth example, the wall panel of the seventh example, wherein the wall opening is a first wall opening, the cover is a first cover, the receptacle is a first receptacle and the electrical assembly further includes a second receptacle, the aperture further includes a second wall opening formed on the second surface. The wall panel further includes a second cover carried by the monolithic wall portion and disposed outwardly from the second surface. The second cover includes a second cover opening, and the second receptacle extends through the second cover opening.

In a ninth example, the wall panel of the seventh example, wherein the aperture is a blind aperture.

In a tenth example, the wall panel of the seventh example, wherein the aperture is a first aperture and the wall opening is a first wall opening. The monolithic wall portion further includes a second aperture including a second wall opening formed on the first surface, the cover opening is a first cover opening, the cover includes a second cover opening, the receptacle is a first receptacle, and the electrical assembly further includes a second receptacle that extends through the second cover opening.

In an eleventh example, a modular workspace system includes a first wall panel, a second wall panel, and a transition cover. The first wall panel includes a first monolithic wall portion, a first cover, and a first electrical assembly. The first monolithic wall portion includes a first surface, a second surface opposite the first surface, and a first aperture including a first wall opening formed on the first surface. The first cover is carried by the first monolithic wall portion and is disposed outwardly from the first surface. The first cover includes a first cover opening. The first electrical assembly is carried in the first aperture, and the first electrical assembly includes a first receptacle extending through the first cover opening. The second wall panel is coupled to the first wall panel, and the second wall panel includes a second monolithic wall portion, a second cover, and a second electrical assembly. The second monolithic wall portion includes a third surface, a fourth surface opposite the third surface, and a second aperture including a second wall opening formed on the third surface. The second cover is carried by the second monolithic wall portion and is disposed outwardly from the third surface. The second cover includes a second cover opening. The second electrical assembly is carried in the second aperture, and the second electrical assembly includes a second receptacle extending through the second cover opening. The transition cover is coupled to the first cover and the second cover at an interface between the first wall panel and the second wall panel.

In a twelfth example, the modular workspace system of the eleventh example, wherein the transition cover includes a first snap connector coupling the first cover to the transition cover and a second snap connector coupling the second cover to the transition cover.

In a thirteenth example, the modular workspace system of the eleventh example, the first wall portion further includes an electrical conduit coupled to the first receptacle, and the electrical conduit extends between the first monolithic wall portion and the transition cover.

In a fourteenth example, the modular workspace system of the thirteenth example, further including a conduit raceway coupled to the transition cover, the electrical conduit extending from transition cover and through the conduit raceway.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
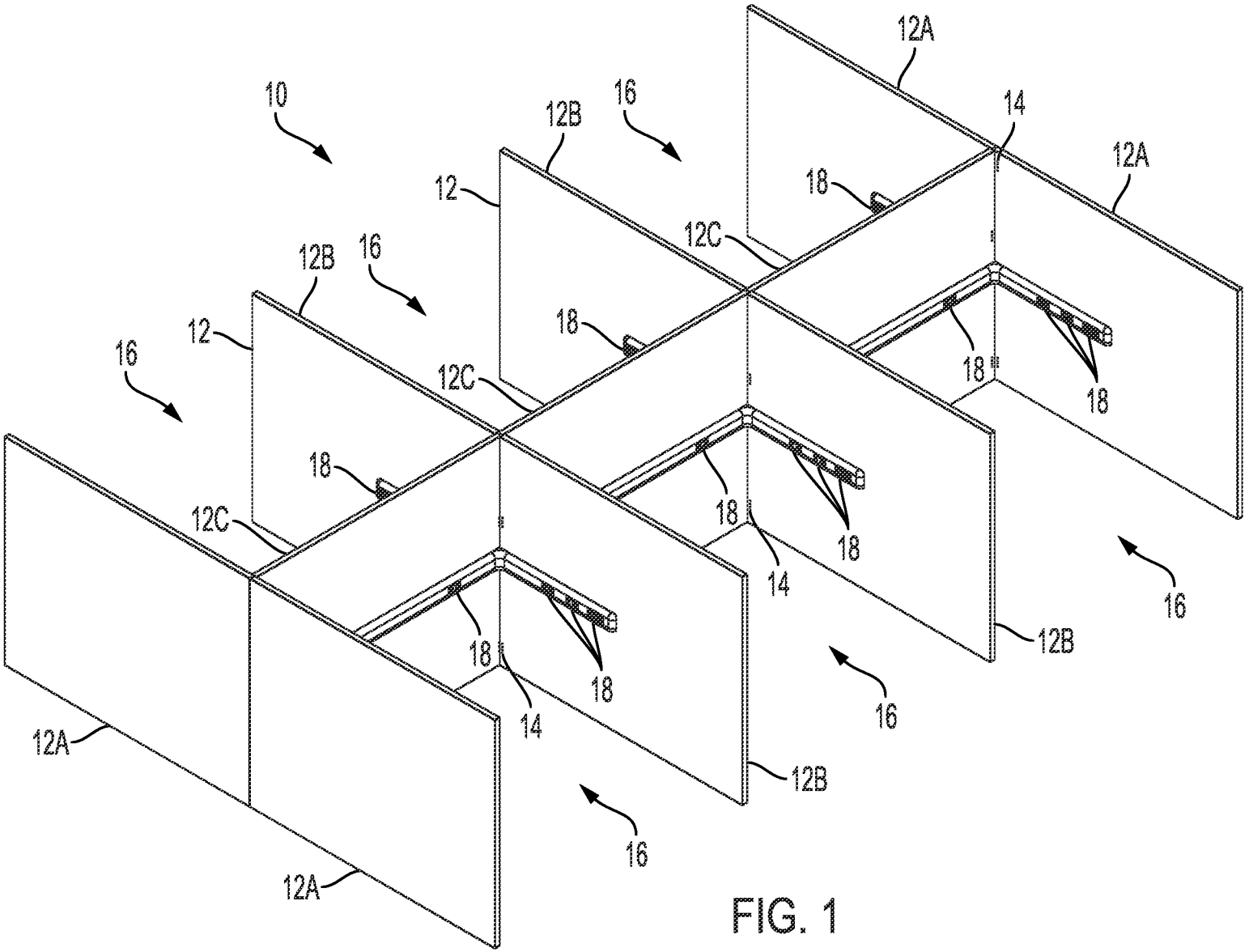
FIG. 1 is a perspective view of a workspace system according to an embodiment of the present invention.

It should be understood that the drawings are intended facilitate understanding of exemplary embodiments of the present invention are not necessarily to scale.

DETAILED DESCRIPTION

The following description refers to the accompanying drawings which show specific embodiments. Although specific embodiments are shown and described, it is to be understood that additional or alternative features are employed in other embodiments. The following detailed description is not to be taken in a limiting sense, and the scope of the claimed invention is defined by the appended claims and their equivalents.

It should be understood that like reference numerals are intended to identify the same structural components, elements, portions, or surfaces consistently throughout the several drawing figures, as such components, elements, portions, or surfaces may be further described or explained by the entire written specification, of which this detailed description is an integral part. Unless otherwise indicated, the drawings are intended to be read (for example, cross-hatching, arrangement of parts, proportion, degree, etc.) together with the specification, and are to be considered a portion of the written description.

Referring to FIG. 1, a workspace system 10 according to an embodiment of the present invention is illustrated. The workspace system 10 includes a plurality of wall panels 12 that are coupled to each other (for example, via fasteners 14) to define workspaces 16. The workspaces 16 may receive furniture items (not shown—for example, desks, chairs, storage cabinets, and the like), and the wall panels 12 include one or more receptacles 18 (for example, electrical receptacles and/or data receptacles) that are accessible to users of the workspaces 16. As described in further detail below, electrical assemblies (shown elsewhere) including the receptacles 18 are partially carried within the walls panels 12. As a result, the receptacles 18 occupy relatively little space within the workspaces 16, and the majority of the space within the workspaces 16 may receive furniture items and/or be used in other beneficial manners.

The workspace system 10 is illustrated as including wall panels 12 that provide the system 10 with two "rows" and three "columns" of workspaces 16. More specifically, the workspace system 10 is illustrated as including four end wall panels 12A (that is, wall panels 12 that are adjacent to a single column of workspaces 16), four wing wall panels 12B (that is, walls panels 12 that are disposed between two columns of workspaces 16), and three spine wall panels 12C (that is, walls panels 12 that are disposed between two rows of workspaces 16). Other embodiments, the workspace system 10 may include different combinations of wall panels 12A, 12B, and 12C and/or other types of wall panels.

Figure 2:
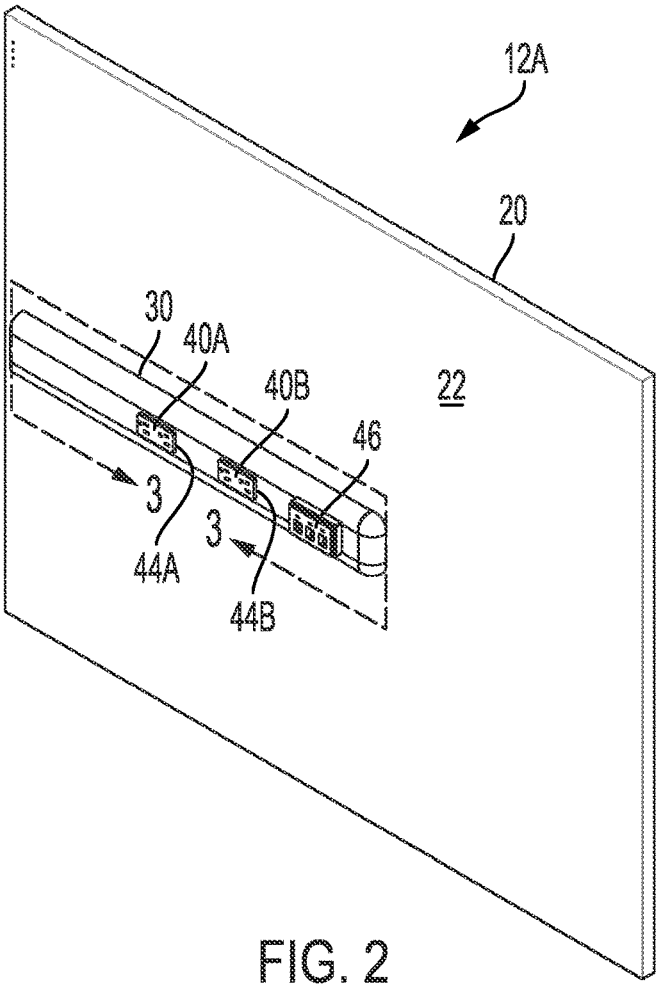
FIG. 2 is a perspective view of an exemplary end wall panel of the workspace system of FIG. 1.
Figure 3:
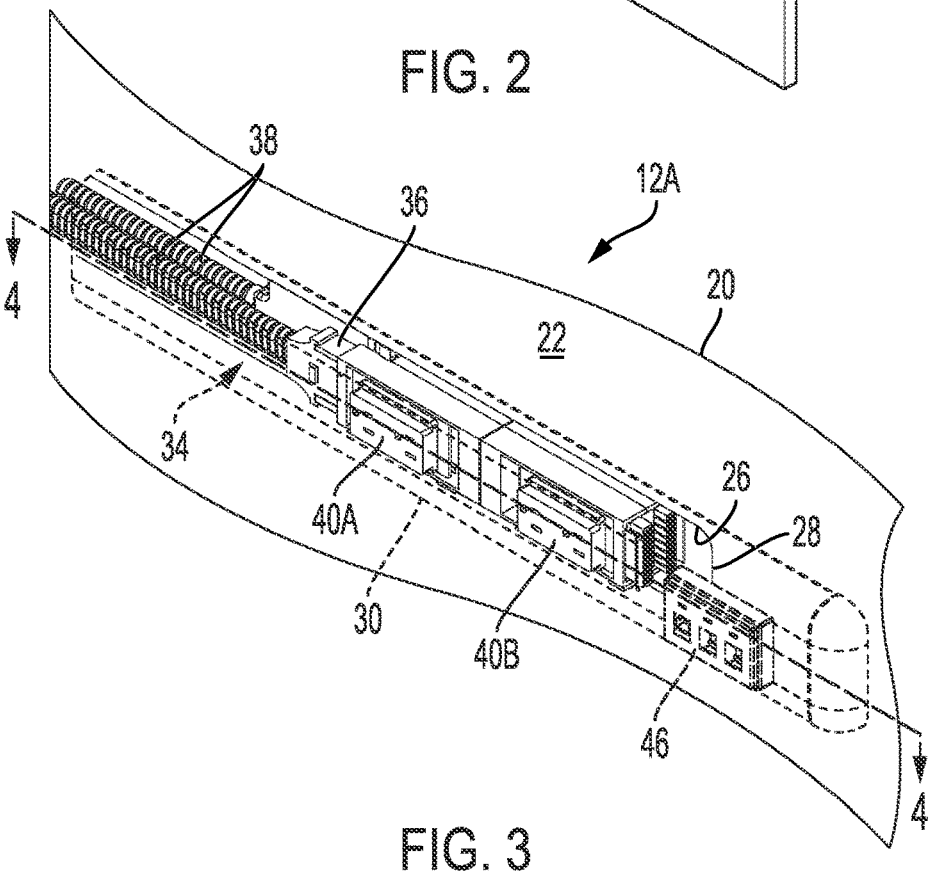
FIG. 3 is a detail perspective view of the area of the end wall panel within line 3-3 of FIG. 2; a cover of the wall panel is shown with phantom lines to illustrate internal components.
Figure 4:
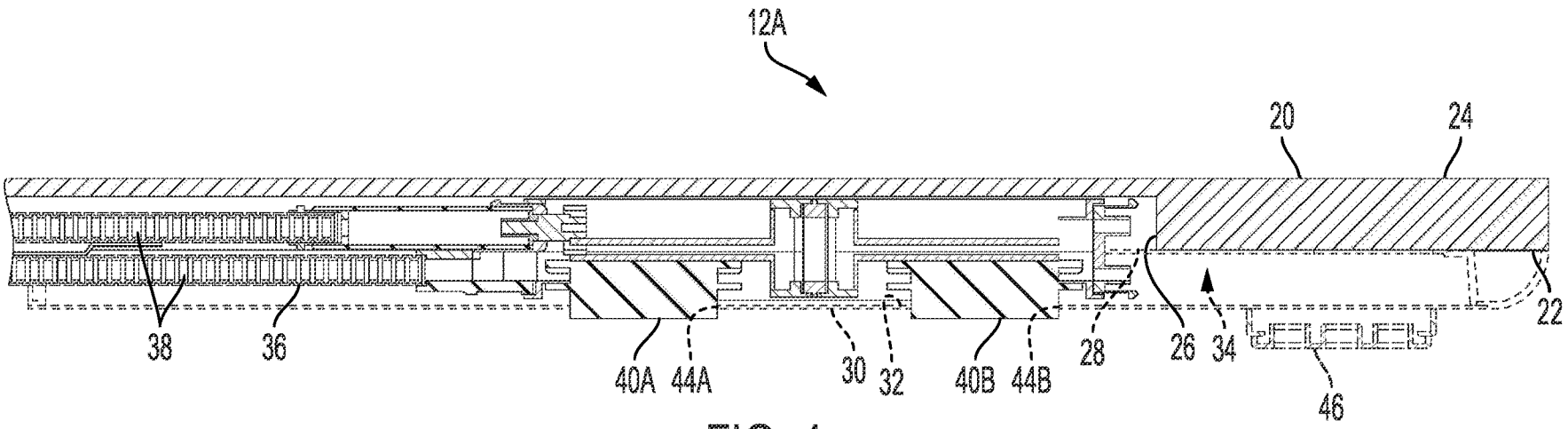
FIG. 4 is a top sectional view of the end wall panel taken along line 4-4 of FIG. 3.

Referring now to FIGS. 2-4, an exemplary end wall panel 12A of the workspace system 10 is illustrated. The other end wall panels 12A may be substantially similar to the exemplary end wall panel 12A, although in the illustrated system 10 some of the other end wall panels 12A are mirror images of the exemplary end wall panel 12A. Alternatively, the other end wall panels 12A may be different than the exemplary end wall panel 12A. The end wall panel 12A includes a monolithic wall portion 20, which may be referred to as a "gallery" wall portion or a "solid" wall portion. The monolithic wall portion 20 may be constructed of various appropriate materials, including, for example, wood. The monolithic wall portion 20 includes a first surface 22 and an opposite second surface 24 (FIG. 4). In some embodiments, one or both of the first surface 22 and the second surface 24 carries a covering material (not shown), such as, for example, protective and/or decorative films or coatings.

Referring specifically to FIGS. 3 and 4, the monolithic wall portion 20 also includes a blind aperture or pocket 26 that partially carries electrical components of the end wall panel 12A. The aperture 26 includes a wall opening 28 formed on the first surface 22 of the monolithic wall portion 20, and the aperture 26 terminates within the monolithic wall portion 20 between the first surface 22 and the second surface 24. The monolithic wall portion 20 carries a cover 30 adjacent to the first surface 22 and the wall opening 28 of the aperture 26. The cover 30 includes a rear channel 32 (FIG. 4) adjacent to the wall opening 28 of the aperture 26. Together the channel 32 and the aperture 26 define an internal chamber 34 that receives the electrical components of the end wall panel 12A.

With continued reference to FIGS. 3 and 4, the electrical components received in the internal chamber 34 of the end wall panel 12A include an electrical assembly 36. The electrical assembly 36 generally includes one or more electrical conduits 38 that carry one or more electrical cords or cables (not shown). The cords are in operable communication with one or more receptacles, illustratively, a first electrical receptacle 40A and a second electrical receptacle 40B. The first electrical receptacle 40A and the second electrical receptacle 40B are supported by a mounting bracket 42 (shown elsewhere) disposed in the blind aperture 26. The first electrical receptacle 40A partially extends through, or is otherwise accessible to a workspace occupant or user, via a first opening 44A formed on the cover 30. Similarly, the second electrical receptacle 40B partially extends through, or is otherwise accessible to a workspace user, via a second opening 44B formed on the cover 30. The electrical conduits 38 may also be in operable communication with one or more receptacles, illustratively, a data receptacle 46 (shown with phantom lines in FIGS. 3 and 4), carried by the cover 30.

Figure 5:
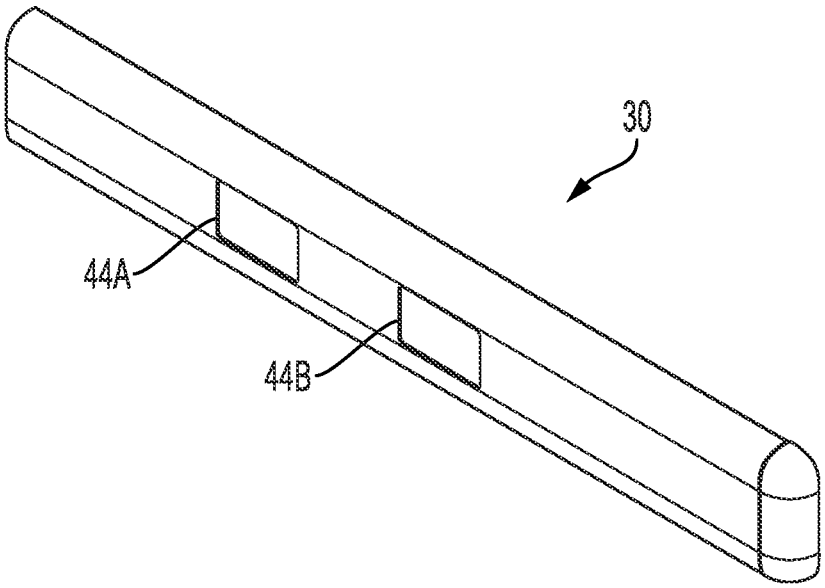
FIG. 5 is a front perspective view of a cover of the end wall panel of FIG. 2.
Figure 6:
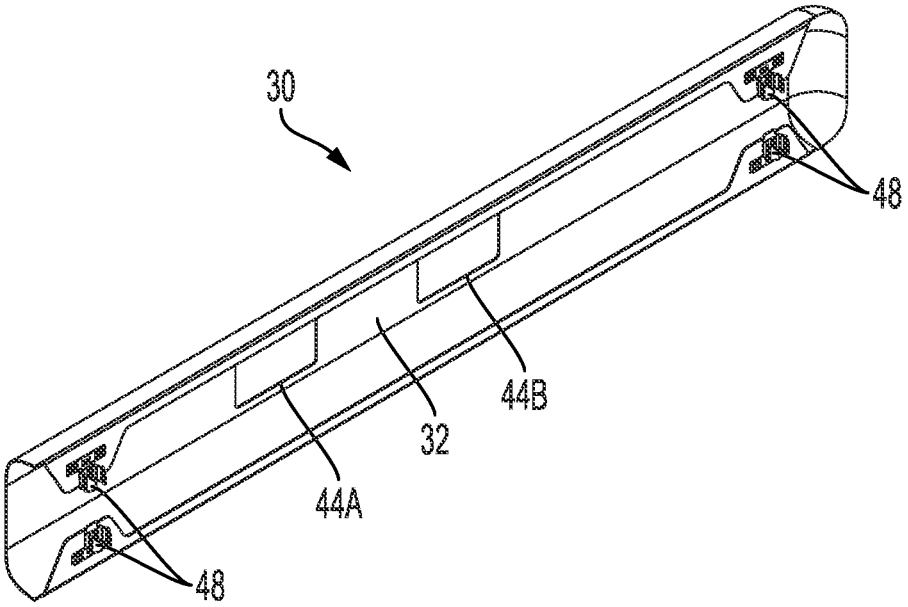
FIG. 6 is a rear perspective view of the cover of FIG. 5.

FIGS. 5 and 6 illustrate the cover 30 of the end wall panel 12A. The cover 30 carries one or more connectors, illustratively, four snap connectors 48, adjacent to the rear channel 32 and opposite the first cover opening 44A and the second cover opening 44B. The connectors 48 facilitate detachably coupling the cover 30 to the monolithic wall portion 20 (shown elsewhere). The cover 30 thereby obscures the wall opening 28 and the majority of the electrical assembly 36 (both shown elsewhere), although the first electrical receptacle 40A and the second electrical receptacle 40B (both shown elsewhere) are accessible via the first cover opening 44A and the second cover opening 44B, respectively.

Figure 7:
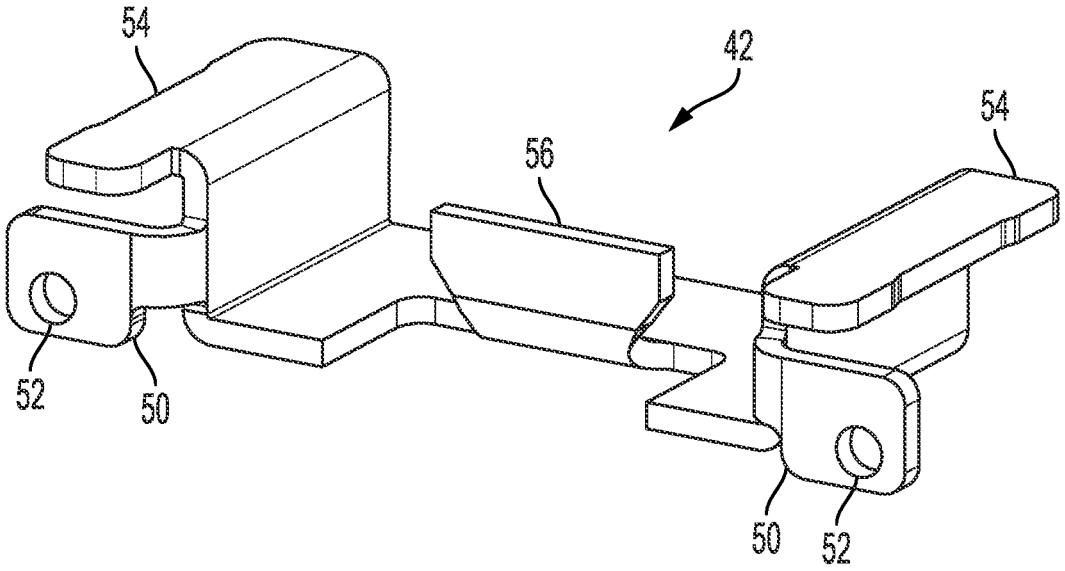
FIG. 7 is a rear perspective view of a mounting bracket of the end wall panel of FIG. 2.
Figure 8:
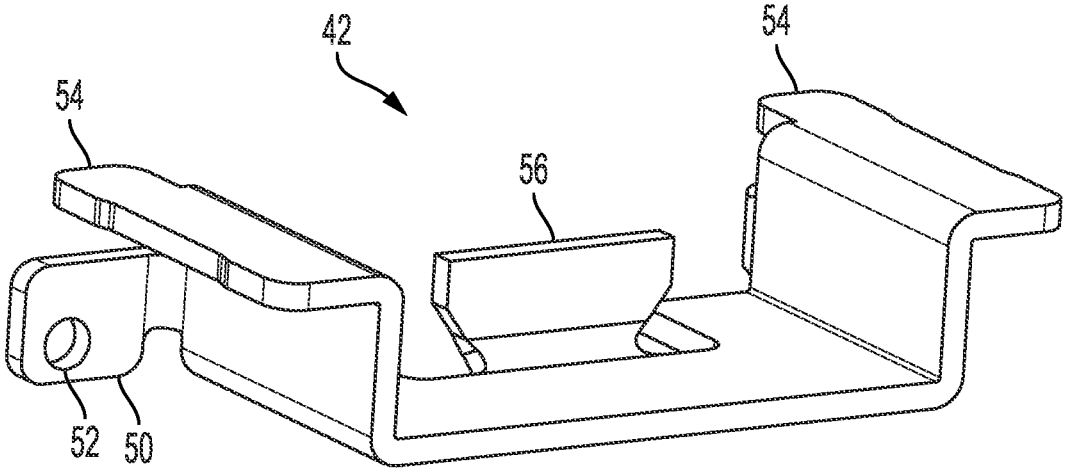
FIG. 8 is a front perspective view of the mounting bracket of FIG. 7.
Figure 9:
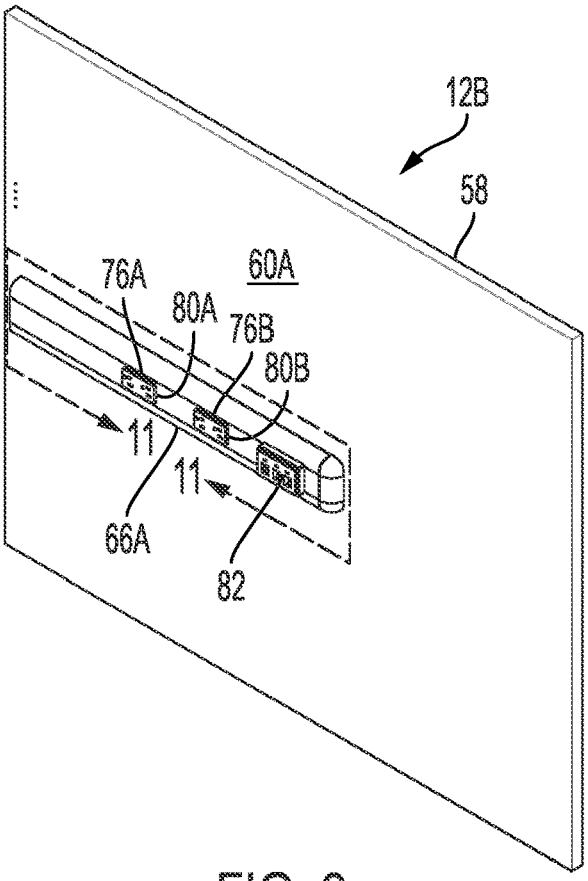
FIG. 9 is a first side perspective view of an exemplary wing wall panel of the workspace system of FIG. 1.

FIGS. 7 and 8 illustrate the mounting bracket 42 of the end wall panel 12A. The mounting bracket 42 includes feet 50 that facilitate coupling the bracket 42 to the monolithic wall portion 20 (illustratively, by receiving fasteners (not shown) in apertures 52). The mounting bracket 42 also includes arms 54 for slidably receiving the first electrical receptacle 40A (shown elsewhere). The mounting bracket 42 further includes a stop 56 for contacting the first electrical receptacle 40A and thereby facilitating proper positioning of the first electrical receptacle 40A relative to the monolithic wall portion 20 and the cover 30 (shown elsewhere).

Figure 10:
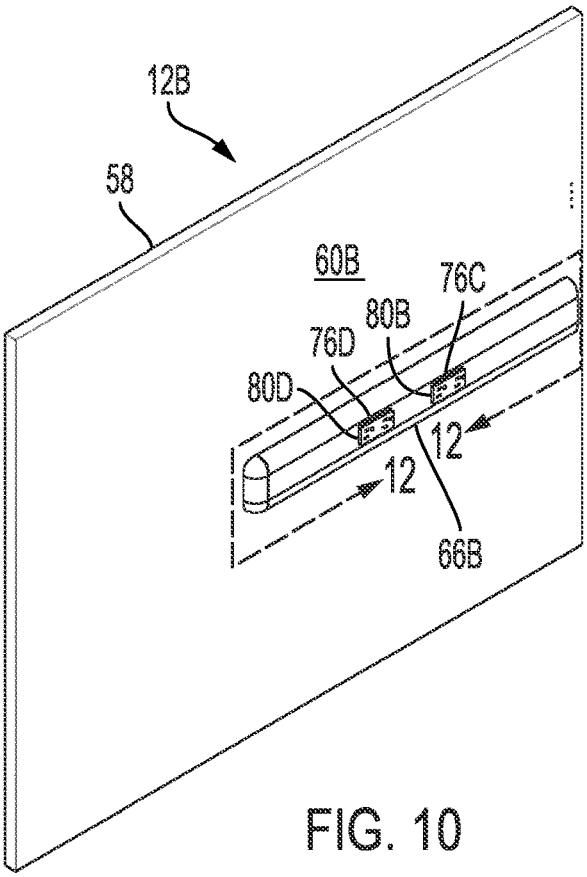
FIG. 10 is a second side perspective view of the wing wall panel of FIG. 9.
Figure 11:
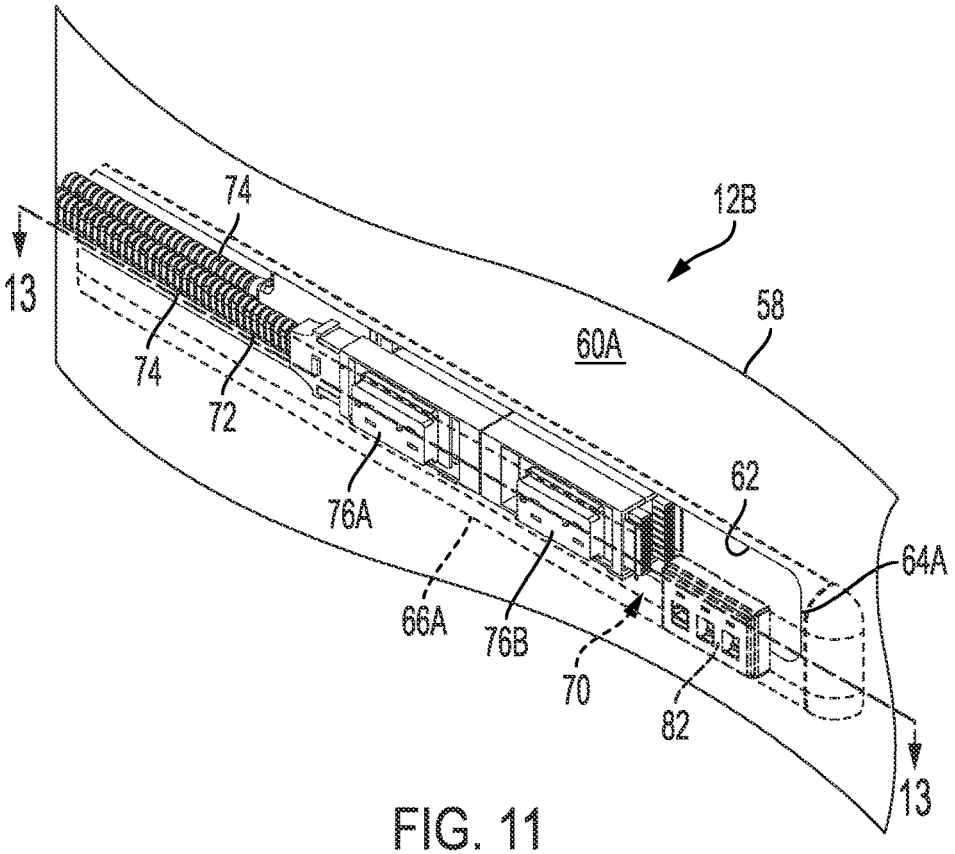
FIG. 11 is a detail perspective view of the area of the wing wall panel within line 11-11 of FIG. 9; a first cover of the wall panel is shown with phantom lines to illustrate internal components.
Figure 12:
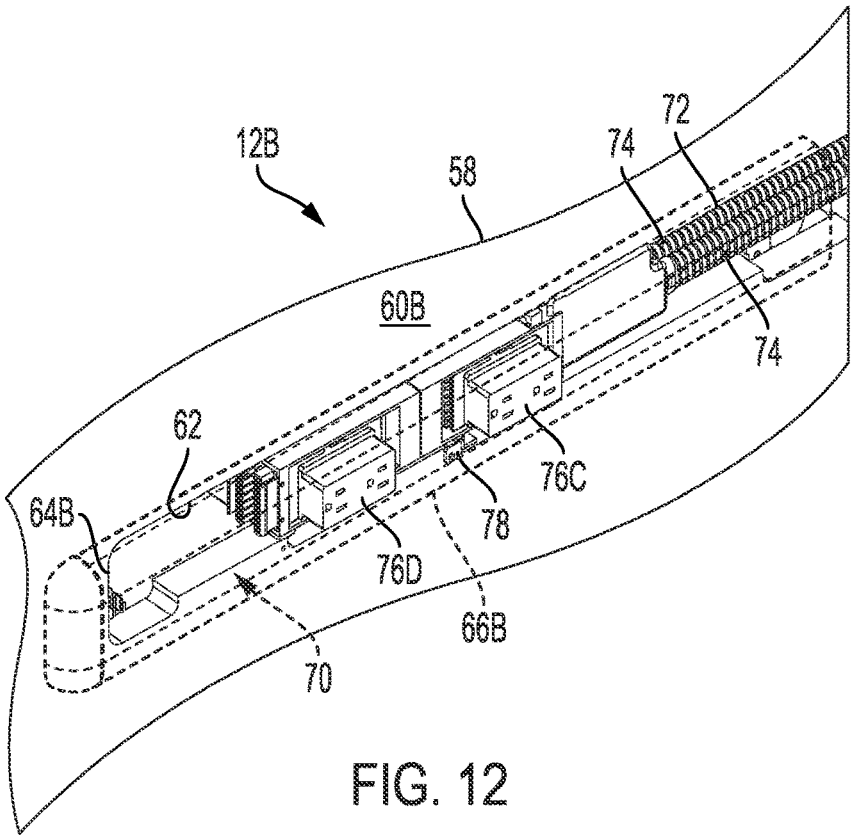
FIG. 12 is a detail perspective view of the area of the wing wall panel within line 12-12 of FIG. 10; a second cover of the wall panel is shown with phantom lines to illustrate internal components.
Figure 13:
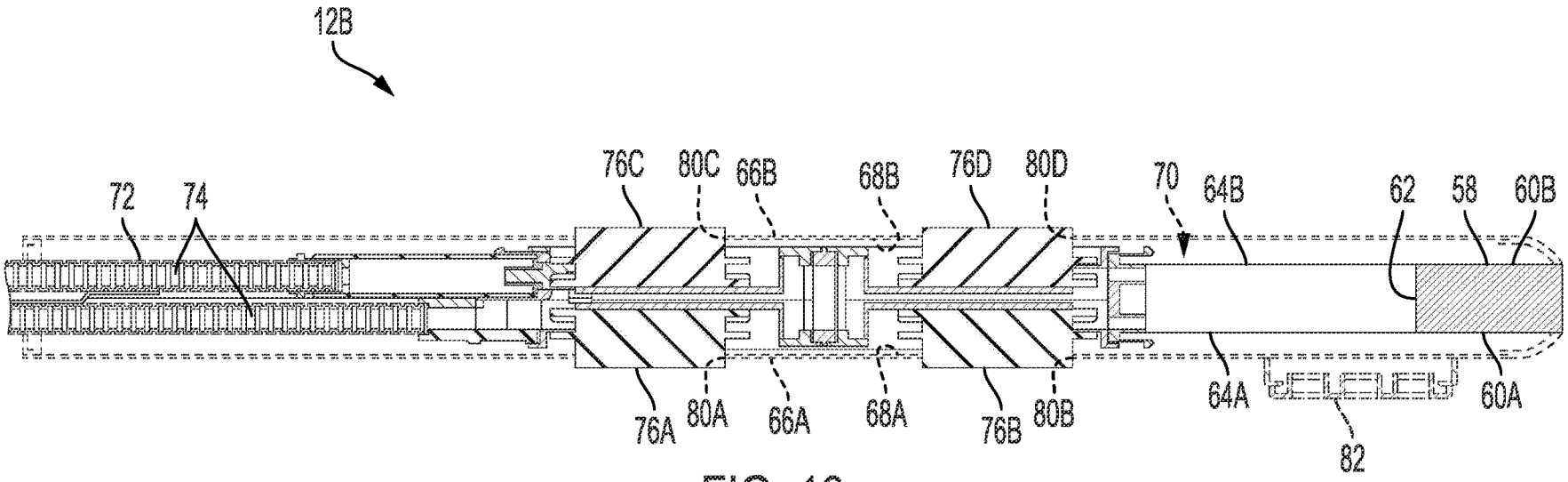
FIG. 13 is a top sectional view of the wing wall panel taken along line 13-13 of FIG. 11.

Referring now to FIGS. 9-13, an exemplary wing wall panel 12B of the workspace system 10 is illustrated. The other wing wall panels 12B may be substantially similar to the exemplary wing wall panel 12B, although in the illustrated system 10 some of the other wing wall panels 12B are mirror images of the exemplary wing wall panel 12B. Alternatively, the other wing wall panels 12B may be different than the exemplary wing wall panel 12B. The wing wall panel 12B includes a monolithic wall portion 58, which may be referred to as a gallery wall portion or a solid wall portion. The monolithic wall portion 58 may be constructed of various appropriate materials, including, for example, wood. The monolithic wall portion 58 includes a first surface 60A (FIGS. 9 and 11) and an opposite second surface 60B (FIGS. 10 and 12). In some embodiments, one or both of the first surface 60A and the second surface 60B carries a covering material (not shown), such as, for example, protective and/or decorative films or coatings.

With continued reference to FIGS. 9-13, the monolithic wall portion 58 also includes a through aperture 62 that partially carries electrical components of the wing wall panel 12B. The aperture 62 includes a first wall opening 64A formed on the first surface 60A of the monolithic wall portion 58 and a second wall opening 64B formed on the second surface 60B of the monolithic wall portion 58. The monolithic wall portion 58 carries a first cover 66A adjacent to the first surface 60A and the first wall opening 64A of the aperture 62. The first cover 66A includes a first rear channel first rear channel 68A (FIG. 13) adjacent to the first wall opening 64A of the aperture 62. The monolithic wall portion 58 also carries a second cover 66B adjacent to the second surface 60B and the second wall opening 64B of the aperture 62. The second cover 66B includes a second rear channel 68B (FIG. 13) adjacent to the second wall opening 64B of the aperture 62. Together the first rear channel first rear channel 68A, the second rear channel 68B, and the aperture 62 define an internal chamber 70 that receives the electrical components of the wing wall panel 12B.

Referring specifically to FIGS. 9-12, the electrical components received in the internal chamber 70 of the wing wall panel 12B include an electrical assembly 72. The electrical assembly 72 generally includes one or more electrical conduits 74 that carry one or more electrical cords or cables (not shown). The cords are in operable communication with one or more receptacles, illustratively, a first electrical receptacle 76A and a second electrical receptacle 76B disposed adjacent the first surface 60A of the wall portion 58 (FIGS. 9 and 11) and a third electrical receptacle 76C and a fourth electrical receptacle 76D disposed adjacent the second surface 60B of the monolithic wall portion 58 (FIGS. 10 and 12). The first electrical receptacle 76A, the second electrical receptacle 76B, the third electrical receptacle 76C, and the fourth electrical receptacle 76D are supported by a mounting bracket 78 (FIG. 12) disposed in the through aperture 62. The first electrical receptacle 76A partially extends through, or is otherwise accessible to a workspace user, via a first opening 80A formed on the first cover 66A. Similarly, the second electrical receptacle 76B partially extends through, or is otherwise accessible to a workspace user, via a second opening 80B formed on the first cover 66A. The third electrical receptacle 76C partially extends through, or is otherwise accessible to a workspace user, via a third opening 80C formed on the second cover 66B. The fourth electrical receptacle 76D partially extends through, or is otherwise accessible to a workspace user, via a fourth opening 80D formed on the second cover 66B. The electrical conduits 74 may also be in operable communication with one or more receptacles, illustratively, a data receptacle 82 (shown with phantom lines in FIGS. 11 and 13), carried by the first cover 66A.

The first cover 66A and/or the second cover 66B may be substantially similar to the cover 30 described above. Alternatively, the first cover 66A and the second cover 66B may be different than the cover 30 described above.

Figure 14:
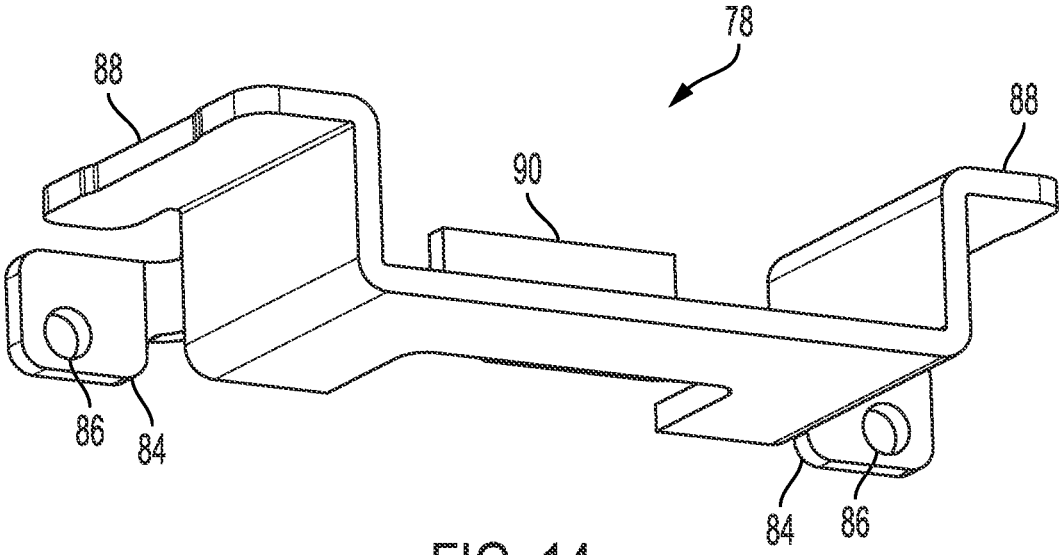
FIG. 14 is a first side perspective view of a mounting bracket of the wing wall panel of FIG. 9.
Figure 15:
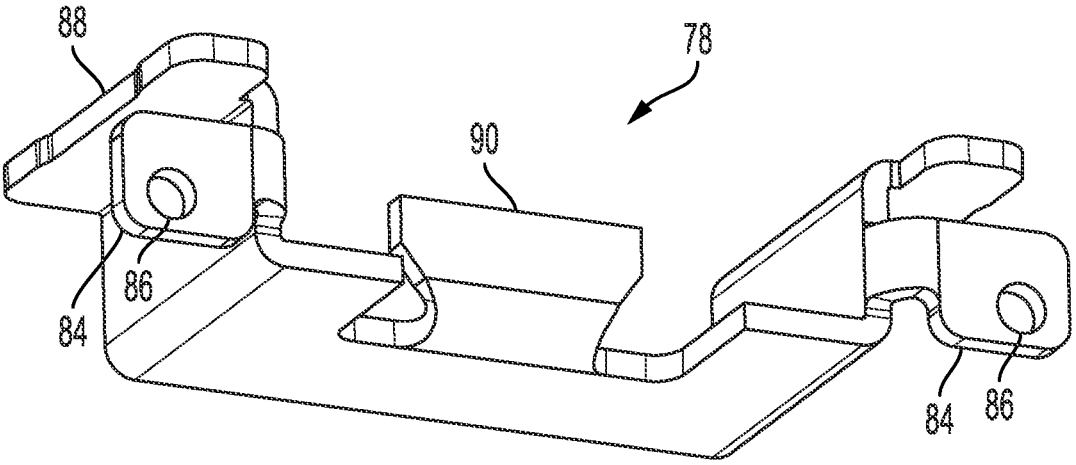
FIG. 15 is a second side perspective view of the mounting bracket of FIG. 14.
Figure 16:
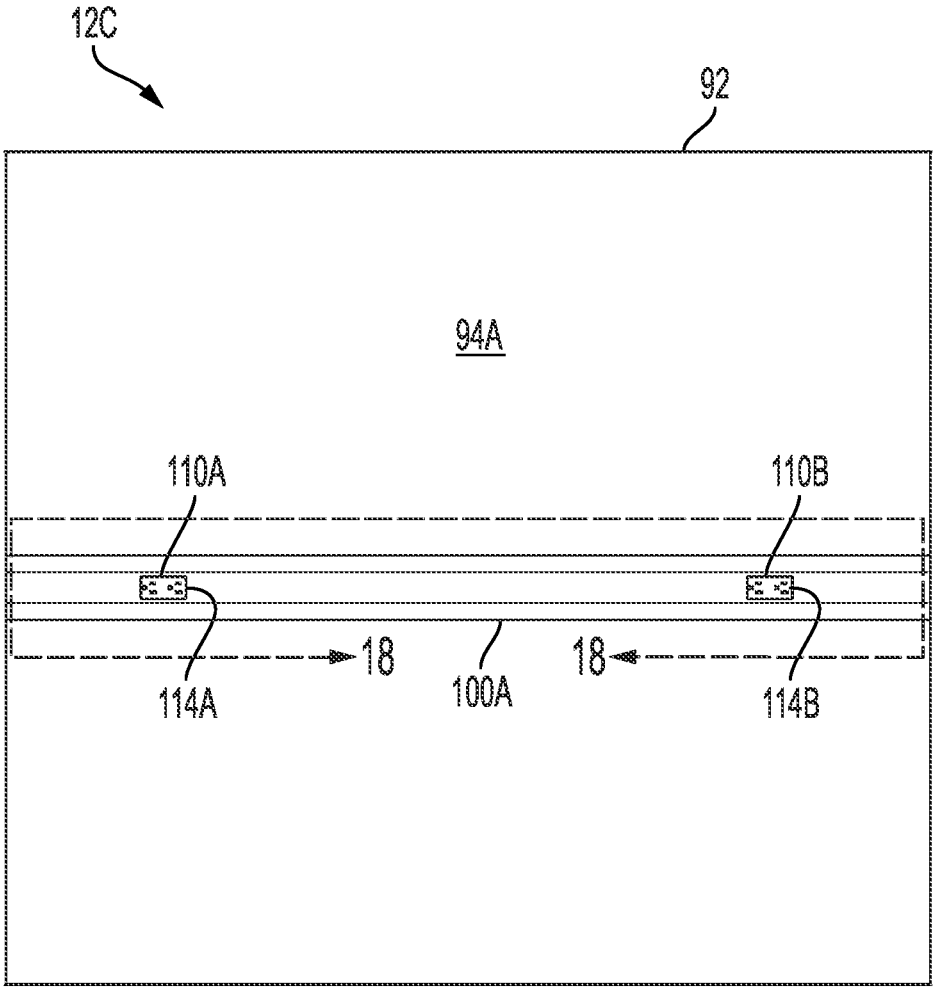
FIG. 16 is a first side view of an exemplary spine wall panel of the workspace system of FIG. 1.

FIGS. 14 and 15 illustrate the mounting bracket 78 of the wing wall panel 12B. The mounting bracket 78 includes feet 84 that facilitate coupling the bracket 78 to the monolithic wall portion 58 (illustratively, by receiving fasteners (not shown) in apertures 86). The mounting bracket 78 also includes arms 88 for slidably receiving the first electrical receptacle 76A and the third electrical receptacle 76C (shown elsewhere). The mounting bracket 78 further includes a stop 90 for contacting the first electrical receptacle 76A and the third electrical receptacle 76C and thereby facilitating proper positioning of the first electrical receptacle 76A and the third electrical receptacle 76C relative to the monolithic wall portion 58 and the covers 66A and 66B (shown elsewhere).

Figure 17:
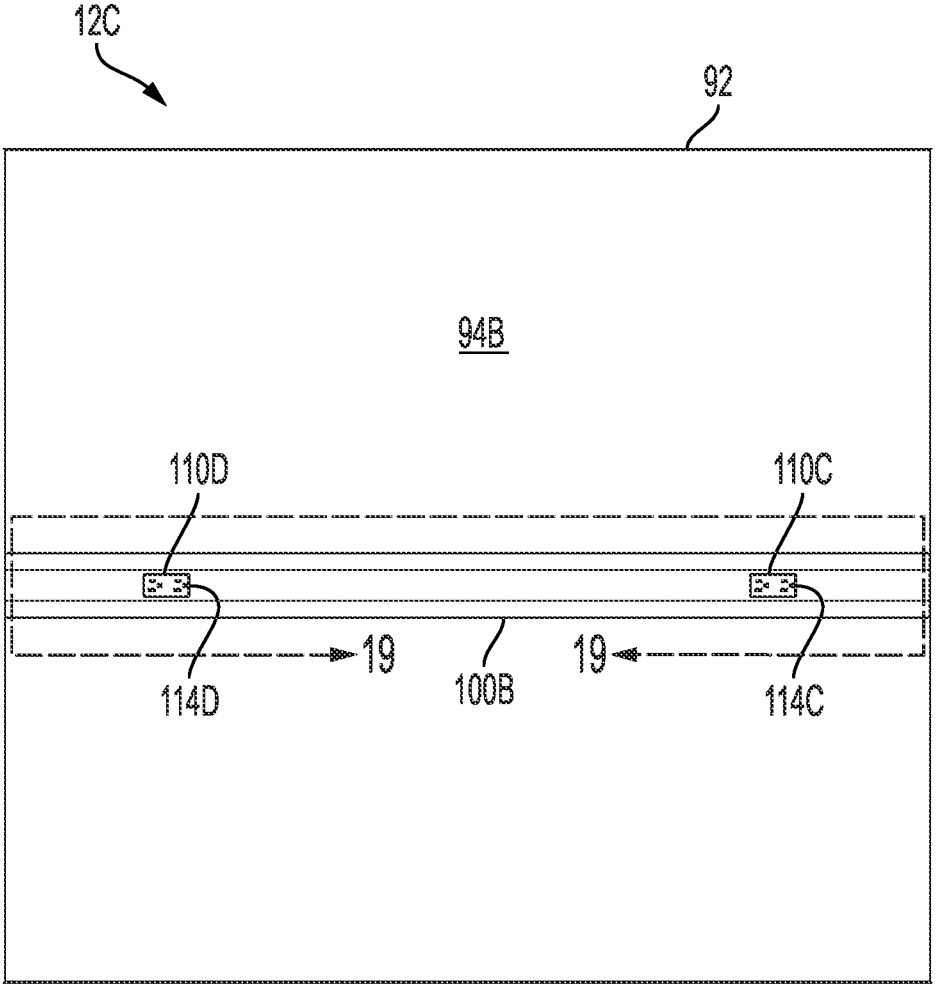
FIG. 17 is a second side view of the spine wall panel of FIG. 16.
Figure 18:
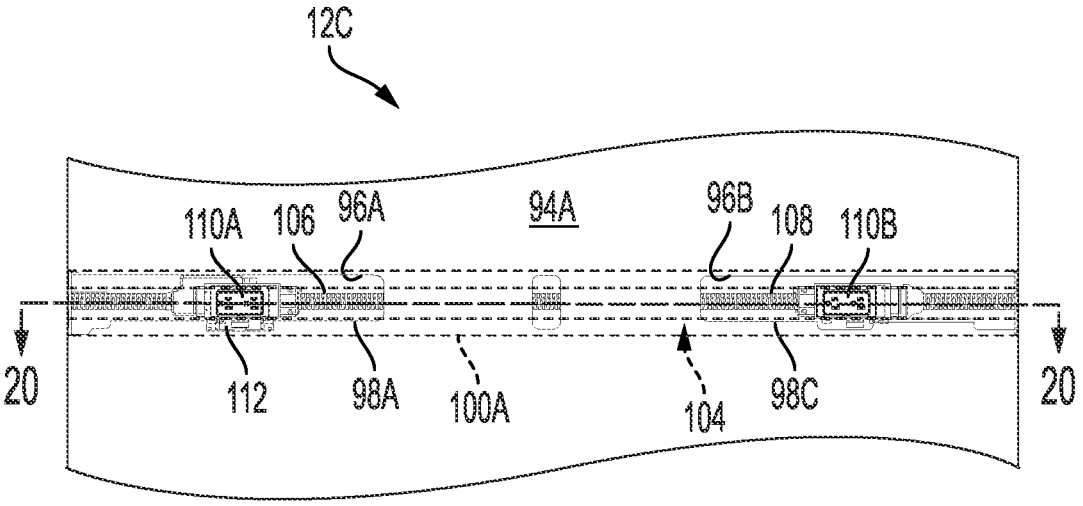
FIG. 18 is a detail view of the area of the spine wall panel within line 18-18 of FIG. 16; a first cover of the wall panel is shown with phantom lines to illustrate internal components.
Figure 19:
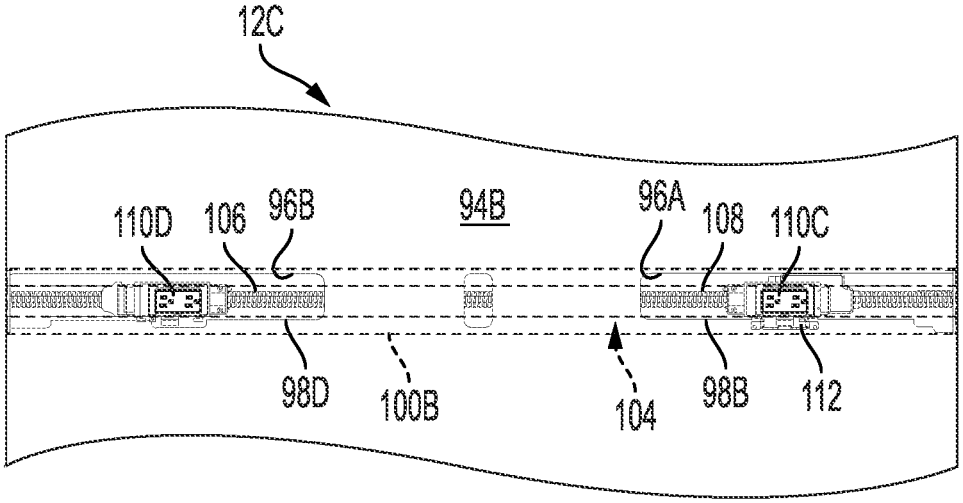
FIG. 19 is a detail view of the area of the spine wall panel within line 19-19 of FIG. 18; a second cover of the wall panel is shown with phantom lines to illustrate internal components.

Referring to FIGS. 16-20, an exemplary spine wall panel 12C of the workspace system 10 is illustrated. The other spine wall panels 12C may be substantially similar to the exemplary spine wall panel 12C. Alternatively, the other spine wall panels 12C may be different than the exemplary spine wall panel 12C. The spine wall panel 12C includes a monolithic wall portion 92, which may be referred to as a gallery wall portion or a solid wall portion. The monolithic wall portion 92 may be constructed of various appropriate materials, including, for example, wood. The monolithic wall portion 92 includes a first surface 94A (FIGS. 16 and 18) and an opposite second surface 94B (FIGS. 17 and 19). In some embodiments, one or both of the first surface 94A and the second surface 94B carries a covering material (not shown), such as, for example, protective and/or decorative films or coatings.

Figure 20:
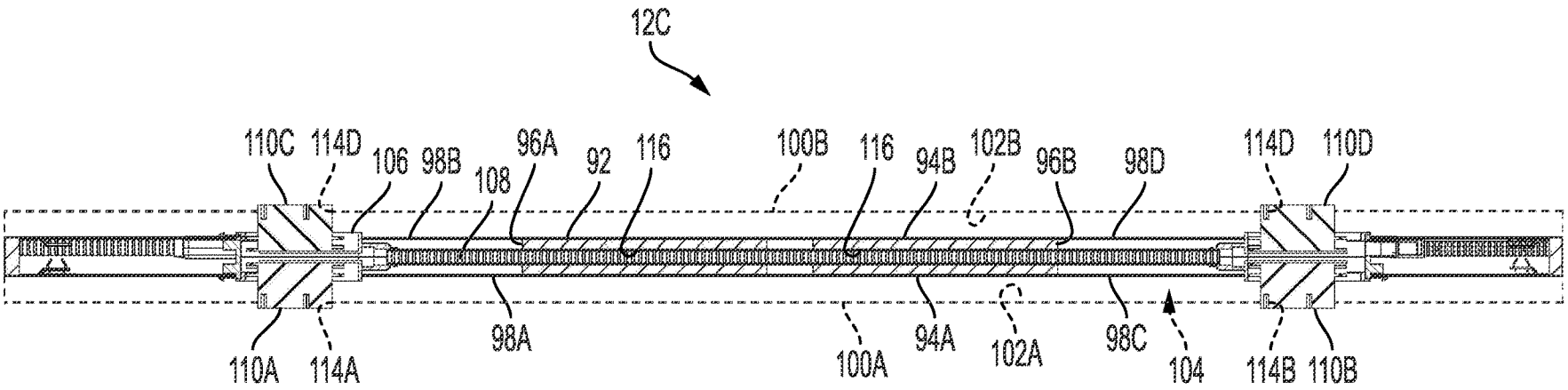
FIG. 20 is a top sectional view of the spine wall panel taken along line 20-20 of FIG. 18.

Referring specifically to FIGS. 18-20, the monolithic wall portion 92 also includes a first through aperture 96A and a second through aperture 96B that partially carry electrical components of the spine wall panel 12C. The first aperture 96A includes a first wall opening 98A formed on the first surface 94A (FIGS. 18 and 20) of the monolithic wall portion 92 and a second wall opening 98B formed on the second surface 94B (FIGS. 19 and 20) of the monolithic wall portion 92. The second aperture 96B includes a third wall opening 98C formed on the first surface 94A (FIGS. 18 and 20) of the monolithic wall portion 92 and a fourth wall opening 98D formed on the second surface 94B (FIGS. 19 and 20) of the monolithic wall portion 92. The monolithic wall portion 92 carries a first cover 100A (FIGS. 18 and 20) adjacent to the first surface 94A, the first wall opening 98A of the first aperture 96A, and the third wall opening 98C of the first aperture 96A. The first cover 100A includes a first rear channel 102A (FIG. 20) adjacent to the first wall opening 98A of the first aperture 96A and the third wall opening 98C of the second aperture 96B. The monolithic wall portion 92 also carries a second cover 100B (FIGS. 19 and 20) adjacent to the second surface 94B, the second wall opening 98B of the first aperture 96A, the fourth wall opening 98D of the second aperture 96B. The second cover 100B includes a second rear channel 102B (FIG. 20) adjacent to the second wall opening 98B of the first aperture 96A and the fourth wall opening 98D of the second aperture 96B. Together the first rear channel 102A, the second rear channel 102B, the first aperture 96A, and the second aperture 96B define an internal chamber 104 that receives the electrical components of the spine wall panel 12C.

With continued reference to FIGS. 18-20, the electrical components received in the internal chamber 104 of the spine wall panel 12C include an electrical assembly 106. The electrical assembly 106 generally includes one or more electrical conduits 108 that carry one or more electrical cords or cables (not shown). The cords are in operable communication with one or more receptacles, illustratively, a first electrical receptacle 110A and a second electrical receptacle 110B disposed adjacent the first surface 94A of the wall portion 92 (FIGS. 18 and 20) and a third electrical receptacle 110C and a fourth electrical receptacle 110D disposed adjacent the second surface 94B of the monolithic wall portion 92 (FIGS. 19 and 20). The first electrical receptacle 110A and the third electrical receptacle 110C are supported by a mounting bracket 112 disposed in the through first aperture 96A. The mounting bracket 112 may be substantially similar to the mounting bracket 78 described above. As shown specifically in FIG. 20, the first electrical receptacle 110A partially extends through, or is otherwise accessible to a workspace user, via a first opening 114A formed on the first cover 100A. Similarly, the second electrical receptacle 110B partially extends through, or is otherwise accessible to a workspace user, via a second opening 114B formed on the first cover 100A. The third electrical receptacle 110C partially extends through, or is otherwise accessible to a workspace user, via a third opening 114C formed on the second cover 100B. The fourth electrical receptacle 110D partially extends through, or is otherwise accessible to a workspace user, via a fourth opening 114D formed on the second cover 100B. The electrical conduits 108 may also be in operable communication with one or more receptacles, illustratively, data receptacles (not shown), carried by the first cover 100A and/or the second cover 100B.

With continued specific reference to FIG. 20, the monolithic wall portion 92 also includes an internal conduit passageway 116 through which the electrical conduits 108 extend. The electrical conduits 108 thereby couple the first and third electrical receptacles 110A, 110C to the second and fourth electrical receptacles 110B, 110D.

Figure 21:
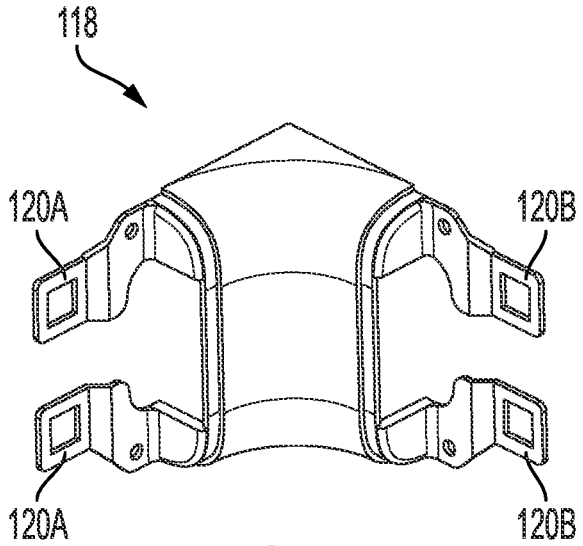
FIG. 21 is a top, front perspective view of an exemplary transition cover of the workspace system of FIG. 1.
Figure 22:
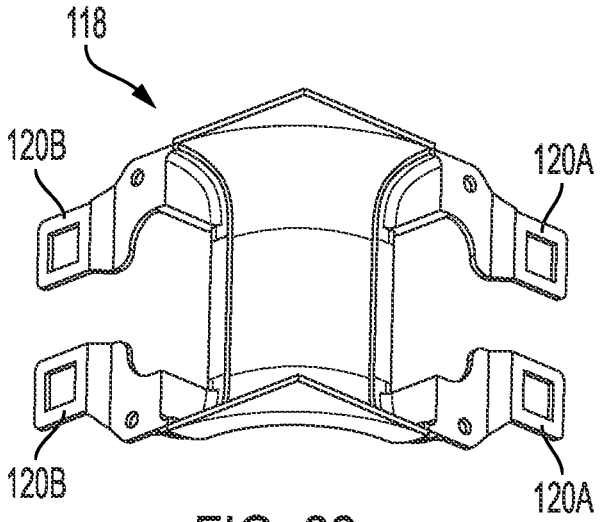
FIG. 22 is a bottom, rear perspective view of the transition cover of FIG. 21.

FIGS. 21 and 22 illustrate an exemplary corner or transition cover 118 for coupling the covers of adjacent wall panels of the workspace system 10 (for example, the covers of an end wall panel 12A and a spine wall panel 12C, or the covers of a wing wall panel 12B and a spine wall panel 12C— all shown elsewhere). The transition cover 118 may obscure electrical conduits (shown elsewhere) carried by one or both of the adjacent wall panels. The transition cover 118 may include connectors for detachably coupling to the covers of one or both of the adjacent wall panels. More specifically, the transition cover 118 includes a pair of first snap connectors 120A for coupling to the cover 118 of one of the wall panels and a pair of second snap connectors 120B for coupling to the cover of the other of the wall panels.

Figure 23:
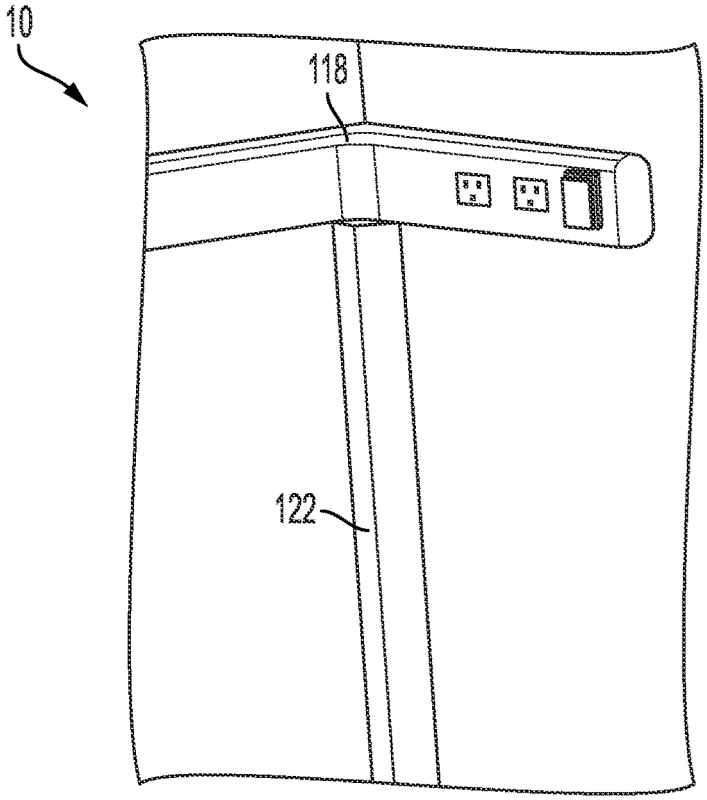
FIG. 23 is a perspective view of adjacent wall panels of the workspace system of FIG. 1 and a raceway conduit.

The electrical conduits carried by the wall panels of the workspace system 10 may be coupled to external power sources (for example, standard wall outlets and the like—not shown) in various manners. For example, the electrical conduits of the wall panels may be coupled to each other, and the electrical conduits of one or more of the end wall panels 12A may extend away from the workspace system 10 to couple to an external power source. As another example and referring to FIG. 23, one or more pairs of adjacent wall panels of the workspace system 10 may carry a conduit raceway 122 that couples to the transition cover 118. The conduit raceway 122 may obscure electrical conduits 38 (shown elsewhere) that extend from the transition cover 118 and toward the ground for coupling to an external power source.

Figure 24:
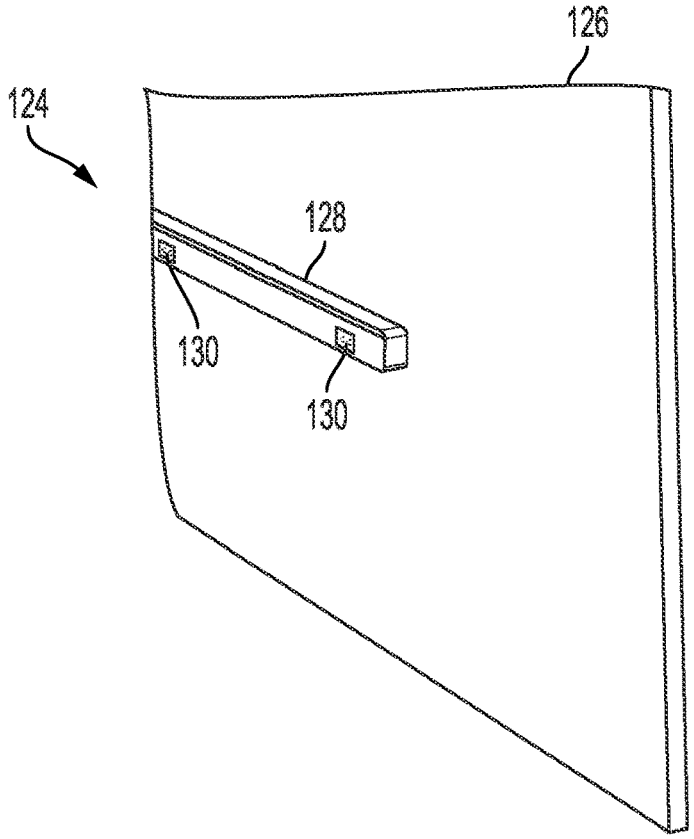
FIG. 24 is a perspective view of an exemplary wall panel according to an embodiment of the present invention.
Figure 25:
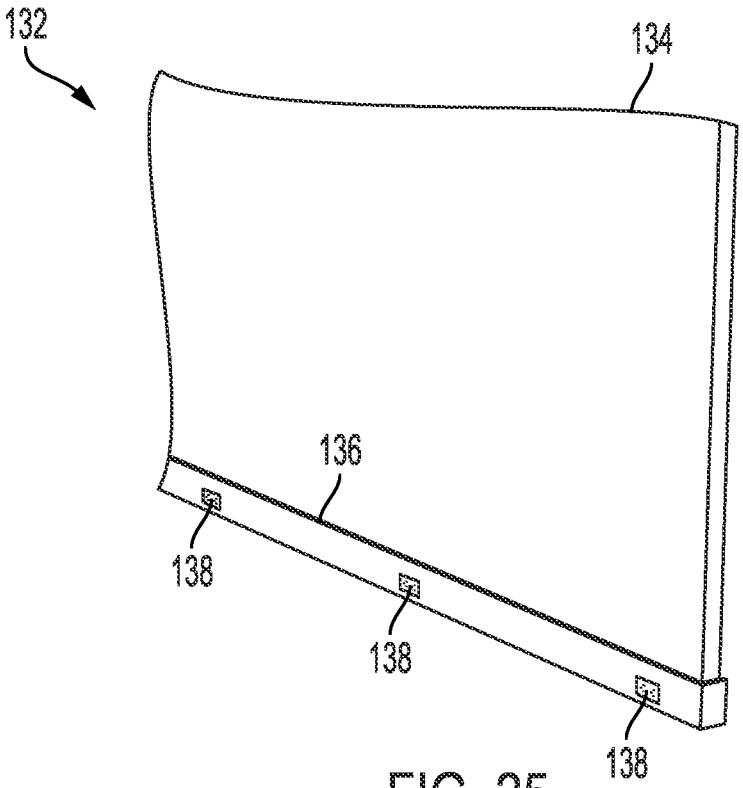
FIG. 25 is a perspective view of an exemplary wall panel according to another embodiment of the present invention.
Figure 26:
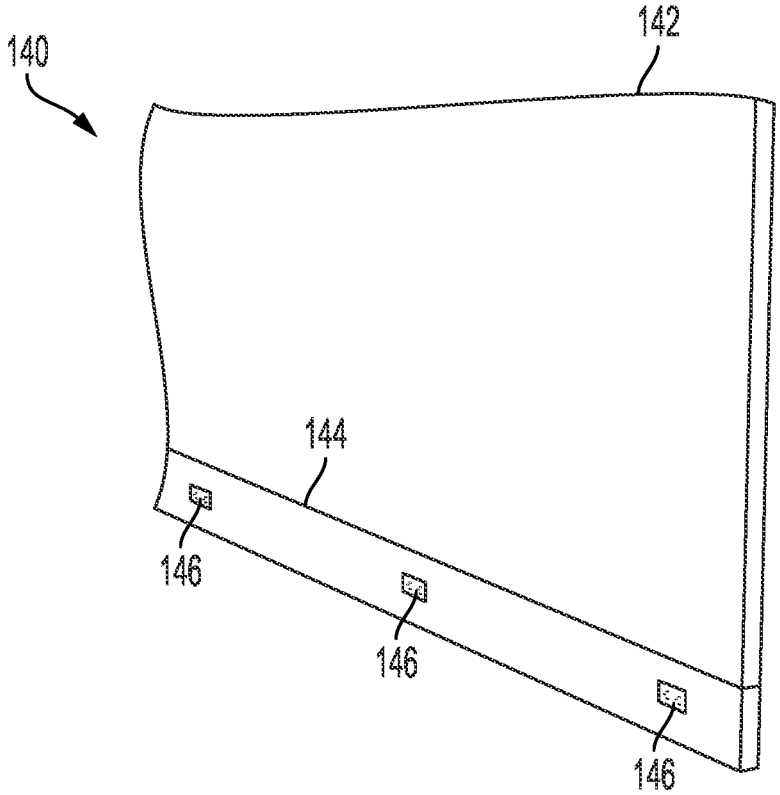
FIG. 26 is a perspective view of an exemplary wall panel according to yet another embodiment of the present invention.

As described briefly above, the workspace system 10 may additionally or alternatively include other types of wall panels. For example, FIG. 24 illustrates a wall panel 124 that includes a monolithic wall portion 126. The monolithic wall portion 126 lacks an aperture, and the wall panel 124 instead includes a surface-mounted conduit 128 that carries an electrical assembly, and the electrical assembly includes one or more receptacles 130. As another example, FIG. 25 illustrates a wall panel 132 that includes a monolithic wall portion 134. The monolithic wall portion 134 lacks an aperture, and the wall panel 132 instead includes a surface-mounted conduit 136 near the bottom of the wall panel 132 that carries an electrical assembly, and the electrical assembly includes one or more receptacles 138. As yet another example, FIG. 26 illustrates a wall panel 140 that includes a monolithic wall portion 142. The monolithic wall portion 142 lacks an aperture, and the wall panel 140 instead includes a conduit 144 mounted to the bottom of the wall panel 140 that carries an electrical assembly, and the electrical assembly includes one or more receptacles 146. The wall panels 124, 132, and 140 are illustrated as end wall panels, although similar panels could be provided as wing wall panels and/or spine wall panels.

In some embodiments, the workspace system 10 may be provided in a disassembled stated, or as a kit, for assembly at an appropriate location.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A wall panel for a workspace system, the wall panel comprising:

a monolithic solid wall comprising a first surface, a second surface opposite the first surface, and an aperture comprising a wall opening formed on the first surface;

a cover carried by the monolithic solid wall and disposed outwardly from the first surface to define an internal chamber together with the aperture, the cover comprising a cover opening; and an electrical assembly partially carried in the internal chamber, the electrical assembly comprising an electrical receptacle disposed outwardly from the aperture, and the electrical receptacle extending through the cover opening.

2. The wall panel of claim 1, wherein the aperture is a blind aperture.

3. The wall panel of claim 1, wherein the electrical assembly further comprises an electrical conduit carried in the aperture.

4. The wall panel of claim 1, wherein the electrical assembly further comprises an electrical conduit disposed outwardly from the aperture of the monolithic solid wall.

5. The wall panel of claim 1, wherein the cover carries a snap connector configured to detachably couple the cover to the monolithic solid wall.

* * * * *